US009808862B2

(12) United States Patent
Verner et al.

(10) Patent No.: US 9,808,862 B2
(45) Date of Patent: Nov. 7, 2017

(54) SYSTEM AND METHODS FOR REMOVING CORE ELEMENTS OF CAST COMPONENTS

(71) Applicant: United Technologies Corporation, Farmington, CT (US)

(72) Inventors: Carl R. Verner, Windsor, CT (US); John Joseph Marcin, Marlborough, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 0 days.

(21) Appl. No.: 15/590,132

(22) Filed: May 9, 2017

(65) Prior Publication Data

US 2017/0239717 A1 Aug. 24, 2017

Related U.S. Application Data

(62) Division of application No. 14/572,474, filed on Dec. 16, 2014.

(60) Provisional application No. 61/918,594, filed on Dec. 19, 2013.

(51) Int. Cl.
*B22D 29/00* (2006.01)
*B22D 30/00* (2006.01)

(52) U.S. Cl.
CPC ..... *B22D 29/003* (2013.01); *B22D 29/00* (2013.01); *B22D 29/002* (2013.01); *B22D 29/006* (2013.01); *B22D 30/00* (2013.01)

(58) Field of Classification Search
CPC ..... B22D 29/002; B01J 3/04
USPC ..... 164/132, 345, 346; 422/242; 134/2
See application file for complete search history.

(56) References Cited

U.S. PATENT DOCUMENTS

| | | | | |
|---|---|---|---|---|
| 3,714,977 | A | 2/1973 | Terkelsen | |
| 5,332,023 | A * | 7/1994 | Mills | B22D 29/002 134/2 |
| 5,779,809 | A | 7/1998 | Sangeeta | |
| 5,915,452 | A | 6/1999 | Conroy et al. | |
| 6,354,310 | B1 * | 3/2002 | Farr | B08B 7/0021 134/105 |
| 6,739,380 | B2 | 5/2004 | Schlienger et al. | |
| 8,056,607 | B2 | 11/2011 | Garlock et al. | |
| 8,409,493 | B2 | 4/2013 | Schlienger et al. | |
| 2012/0222961 | A1 | 9/2012 | Smallwood et al. | |
| 2015/0174653 | A1 | 6/2015 | Verner et al. | |

* cited by examiner

*Primary Examiner* — Kevin E Yoon
(74) *Attorney, Agent, or Firm* — Cantor Colburn LLP

(57) ABSTRACT

A system and methods are provided for removing core elements of cast components. In one embodiment, a method includes controlling a first high temperature autoclave cycle for a cast component in a vessel with a first solution concentration to remove at least a first portion of core elements, wherein the first solution concentration, temperature and pressure in the vessel are controlled to expose one or more casting pins in the cast component. The method may also include controlling a second high temperature autoclave cycle for the cast component in the vessel with second solution concentration, wherein the second solution concentration, temperature and pressure in the vessel during the second high temperature autoclave cycle are controlled to loosen one or more of the casting pins from the cast component, and controlling one or more low temperature autoclave cycles to remove core and casting pins from the cast component.

10 Claims, 3 Drawing Sheets

SYSTEM AND METHODS FOR REMOVING CORE ELEMENTS OF CAST COMPONENTS

CROSS REFERENCE TO RELATED APPLICATIONS

This application is a divisional application of U.S. application Ser. No. 14/572,474, filed Dec. 16, 2014, which claims benefit of an earlier filing date from U.S. Provisional Application Ser. No. 61/918,594, filed Dec. 19, 2013, the disclosures of which are incorporated by reference herein in their entireties.

FIELD

The present disclosure relates generally to metal casting, and more particularly to a system and methods for removal of core and pin elements from cast components.

BACKGROUND

Investment casting, or die casting, is a known technique for forming metallic components having complex geometries, especially hollow components, and is used in the fabrication of gas turbine engine components.

Cast hardware can include one or more core elements to produce internal and external features. In some cases, internal independent parts can be attached and assembled together. These elements may be difficult to remove after casting, especially for complex cores and long or narrow passages. Casting pins can be used to produce features or strengthen sections of the cores and may be particularly difficult to remove.

Conventional core removal methods may employ open vessels, which take a long time and in many cases, such as open pot leach, the process is ineffective for removal of complex cores or casting pins. Conventional sealed autoclaves are typically large and require a complex agitation system to change pressure. In some cases no system for pressure change is used. Accordingly, there is a desire to improve removal of core elements.

BRIEF SUMMARY OF THE EMBODIMENTS

Disclosed and claimed herein are a system and methods for removing core elements of cast components. In one embodiment, a method includes controlling a first high temperature autoclave cycle for a cast component in a vessel with a first solution concentration to remove at least a first portion of core elements, wherein the first solution concentration, temperature and pressure in the vessel are controlled to expose one or more casting pins in the cast component, and controlling a second high temperature autoclave cycle for the cast component in the vessel with second solution concentration, wherein the second solution concentration, temperature and pressure in the vessel during the second high temperature autoclave cycle are controlled to loosen one or more of the casting pins from the cast component. The method also includes controlling one or more low temperature autoclave cycles following the second high temperature cycle to remove core and casting pins from the cast component.

In one embodiment, a system for removing core elements of cast components includes a vessel and a controller configured to control solution concentration, temperature and pressure in the vessel. According to one embodiment, the controller is configured to control a first high temperature autoclave cycle for a cast component in the vessel with a first solution concentration to remove at least a first portion of core elements, wherein the first solution concentration, temperature and pressure in the vessel are controlled to expose one or more casting pins in the cast component, control a second high temperature autoclave cycle for the cast component in the vessel with second solution concentration, wherein the second solution concentration, temperature and pressure in the vessel during the second high temperature autoclave cycle are controlled to loosen one or more of the casting pins from the cast component, and control one or more low temperature autoclave cycles following the second high temperature cycle to remove core and casting pins from the cast component.

Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

One aspect of the disclosure relates to removal of core material and elements from core passages of a cast component. In one embodiment, a method is provided for removing core material and elements from cast components, such as cast blades, vanes and other gas turbine hardware having complex core passages that serpentine through the casting. Core material, such as the ceramic core, and other core elements, such as quartz or alumina casting pins, may be removed by a process of one or more autoclave cycles. In one embodiment, a method includes high temperature and low temperature autoclave cycles, wherein a solution concentration, temperature and pressure in an autoclave vessel are controlled to loosen and remove one or more core elements from a cast component.

According to another embodiment, a system for removing core elements of cast components includes a vessel and a controller configured to control one or more of a solution concentration, temperature and pressure in the vessel. The vessel may include one or more coiling coils to produce quick temperature and pressure changes in the vessel.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

Exemplary Embodiments

Figure 1:
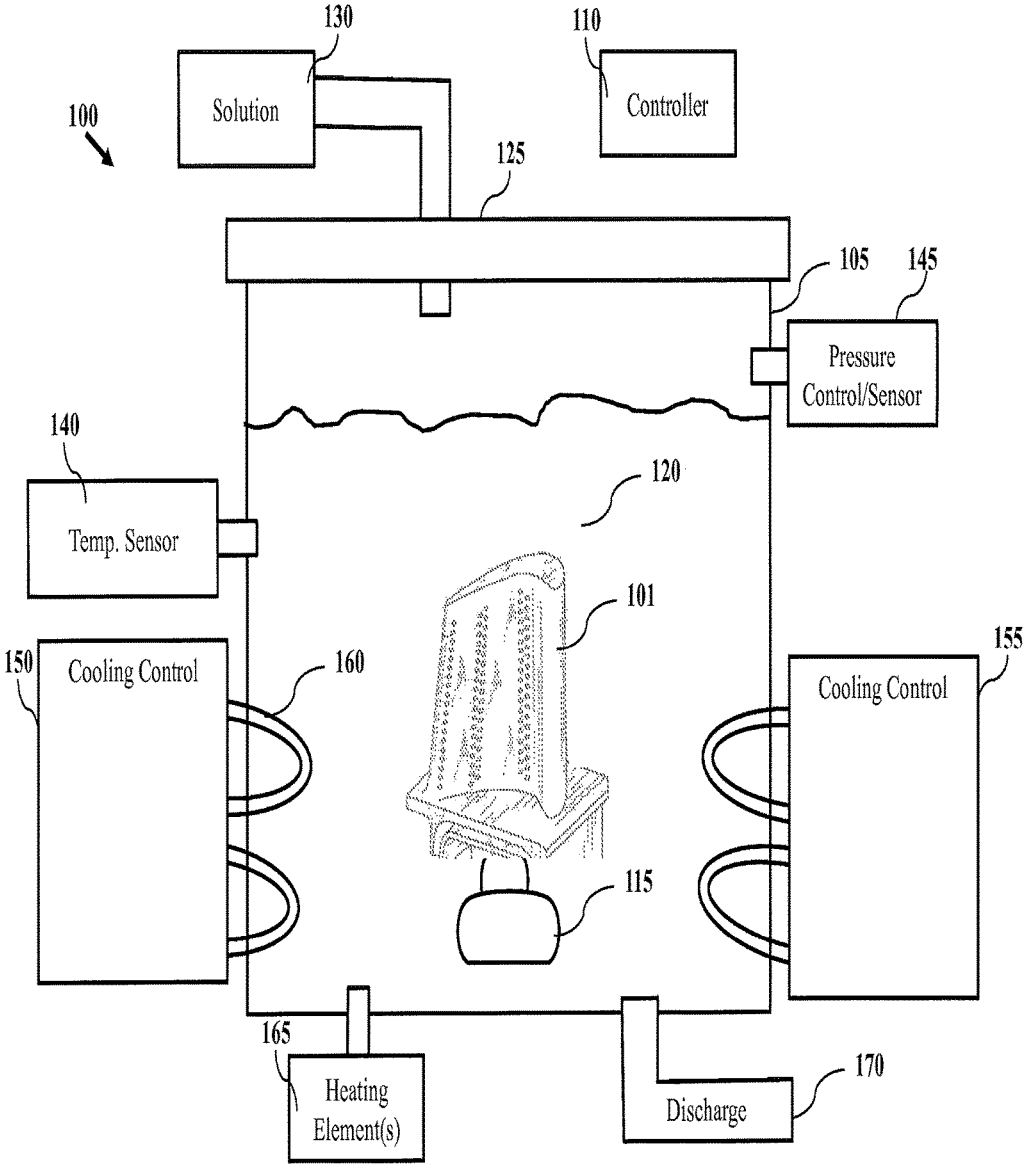
FIG. 1 depicts a simplified system diagram of a core removal system according to one or more embodiments.

Referring now to the figures, FIG. 1 depicts a simplified system diagram of a core removal system according to one or more embodiments. System 100 may be configured to remove one or more core elements from a cast component, shown as 101, including ceramic core elements and casting pins. Cast component 101 may be cast blades, vanes, blade outer air seals, other gas turbine engine components, and other hardware with core passages.

According to one embodiment, system 100 may include autoclave equipment, including vessel 105 for flushing cast component 101 with a solution under controlled, temperatures and pressures to remove core elements from the cast component. As shown in FIG. 1, system 100 includes vessel 105 and controller 110. Controller 110 may be electrically coupled to one or more elements of system 100 to control one or more autoclave cycles.

Vessel 105 can contain cast component 101 mounted to a component 115 and solution 120. In one embodiment, vessel 105 may have a small capacity, such as a volume within the range of 1-50 gallons. Using a small volume vessel may allow for lower mass, and lower time to raise and lower temperature of the vessel, and vessel contents (e.g., liquids, solutions, casting parts, etc.). It should be appreciated that in certain embodiments, vessel 105 may be a large vessel with specific controls to allow for rapid heat up and cool down. Vessel 105 is sealed by cover 125. Solution 120 may be provided to vessel 105, and replenished by, solution source 130.

Temperature sensor 140 may be configured to monitor the temperature inside vessel 105 and the temperature of solution 120. Pressure controller/sensor 145 may be configured to detect the pressure inside of vessel 105. In certain embodiments, pressure control/sensor 145 may pressurize the vessel. The output of temperature sensor 140 and pressure control/sensor 145 may be employed by controller 110 to control the temperature and/or pressure in vessel 105.

Cooling controls 150 and 155 may each include one or more cooling coils, shown as 160 for rapidly cooling solution 120. Heating elements 165 may be configured to heat vessel 105 and/or solution 120. Cooling controls 150 and 155 and heating elements 165 may be controlled by controller 105. In one embodiment, controller 105 may be configured to control solution concentration, temperature and pressure in the vessel for one or more autoclave cycles.

Discharge assembly 170 may be configured to flush solution 120 and or removed core material during one or more autoclave cycles.

Figure 2:
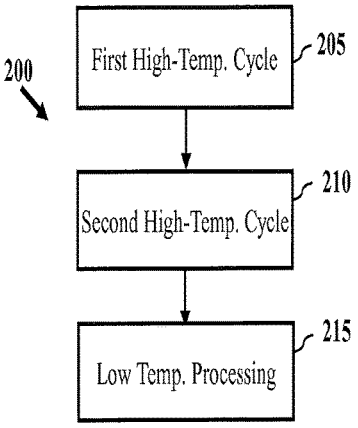
FIG. 2 depicts a method for removing core components according to one or more embodiments.

FIG. 2 depicts a method for removing core components according to one or more embodiments. According to one embodiment, process 200 may be employed to control a system for removing core elements (e.g., system 100 of FIG. 1). Process 200 may be employed by a controller (e.g., controller 105) to control one or more autoclave cycles. According to another embodiment, autoclave cycles of process 200 may be controlled to remove core elements including ceramic cores and alumina casting pins.

Process 200 may be initiated at block 205 with a first high temperature autoclave cycle. According to one embodiment, the first high temperature autoclave cycle may be for a cast component in a vessel with a first solution concentration to remove at least a first portion of core elements. The first solution concentration, temperature and pressure in the vessel may be controlled during the first high temperature autoclave cycle to expose one or more casting pins in the cast component. According to one embodiment, the first high temperature autoclave cycle includes heating the vessel to a temperature within the range of 200 to 400 degrees F. (e.g., 95-200 degrees C.). In one embodiment, first high temperature autoclave cycle may employ a solution of less than 40% KOH or less than 40% NaOH. In certain embodiments, the first high temperature autoclave cycle may employ a solution of 20%-30% of KOH or 20%-30% of NaOH. The first high temperature autoclave cycle may be controlled to remove a first leg of core components, such as a serpentine core and expose casting pin. In one embodiment, the first high temperature autoclave cycle may be a 12 hour cycle. It should be appreciated that shorter or longer time periods may be employed for the first high temperature autoclave cycle.

At block 210, a second temperature autoclave cycle at is initiated for the cast component in the vessel with second solution concentration. The second cycle may be directed to components that are difficult to remove due to access or material composition. The second solution concentration, temperature and pressure in the vessel during the second high temperature autoclave cycle are controlled to loosen one or more of the casting pins from the cast component. According to one embodiment, the second high temperature autoclave cycle includes heating the vessel to a temperature within the range of 400 to 600 degrees F. (e.g., 200-315 degrees C.). In one embodiment, the second high temperature autoclave cycle may employ a solution of at least 40% of KOH or at least 40% of NaOH. By way of example, the second high temperature autoclave cycle may employ a solution of 40%-50% of KOH or 40%-50% of NaOH. The second high temperature autoclave cycle may be controlled to remove core components and casting pins from the cast component, in particular pins made from aluminum oxide. In one embodiment, the second high temperature autoclave cycle may be a 12 hour cycle. It should be appreciated that shorter or longer time periods may be employed for the second high temperature autoclave cycle.

Each of the high temperature autoclave cycles in process 200 may include a cooling cycle that is controlled to cycled on and off multiple times during each autoclave cycle to provide repetitive and rapid pressure changes in the vessel, promote agitation, and promote a flushing action in the solution.

At block 215, one or more low temperature cycles may be performed in the vessel. In one embodiment, between 3-5 low temperature autoclave cycles are initiated in the vessel. However, it should be appreciated that additional or fewer low temperature cycles may be performed. The one or more low temperature cycles may include controlling the temperature of a vessel to be below 200 degrees F.

The autoclave cycles for removal of core components and casting pins in process 200 may be initiated in a vessel having a volume within the range of 5-10 gallons. According to one embodiment, each autoclave cycle includes flushing the cast component to remove one or more of core and casting pin material.

Figure 3:
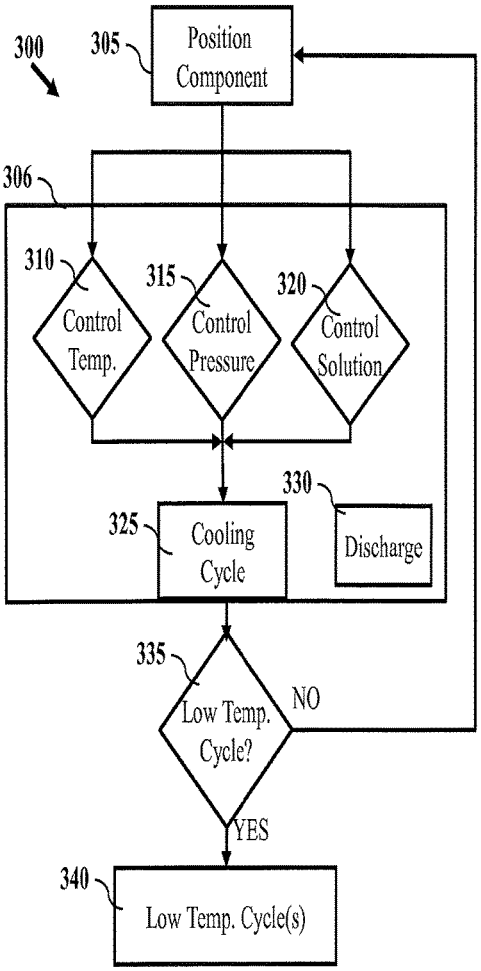
FIG. 3 depicts a graphical representation of autoclave cycles according to one or more other embodiments.

FIG. 3 depicts a flow diagram of autoclave processing and process parameters according to one or more embodiments. Process 300 may be initiated by positioning a component at block 305. According to one embodiment, parts may be alternately positioned root side up or root side down in a vessel at block 305. In certain embodiments, the position of cast parts may be alternated during each autoclave cycle. According to one embodiment, one or more parameters may be controlled during each autoclave cycle. Process 300 includes one or more high temperature autoclave cycles 306 including controlling temperature at block 310, pressure at block 315 and solution at block 320. High temperature autoclave cycle 306 includes a cooling cycle 325 which may be cycled on or off multiple times per hour to achieve repetitive and rapid pressure change in the vessel. Cycle 306 may also include discharge of core elements and/or solution during the cycle at block 330. Following high temperature autoclave cycle 306, decision block 335 may determine whether to initiate a low temperature cycle. When additional high temperature cycles are required (e.g., "NO" path out of decision block 335), process 300 may continue with a high temperature autoclave cycle, similar to cycle 306. Process 300 may determine a low temperature cycle is to be performed (e.g., "YES" path out of decision block 335) and conduct one or more low temperature cycles at block 340.

Figure 4:
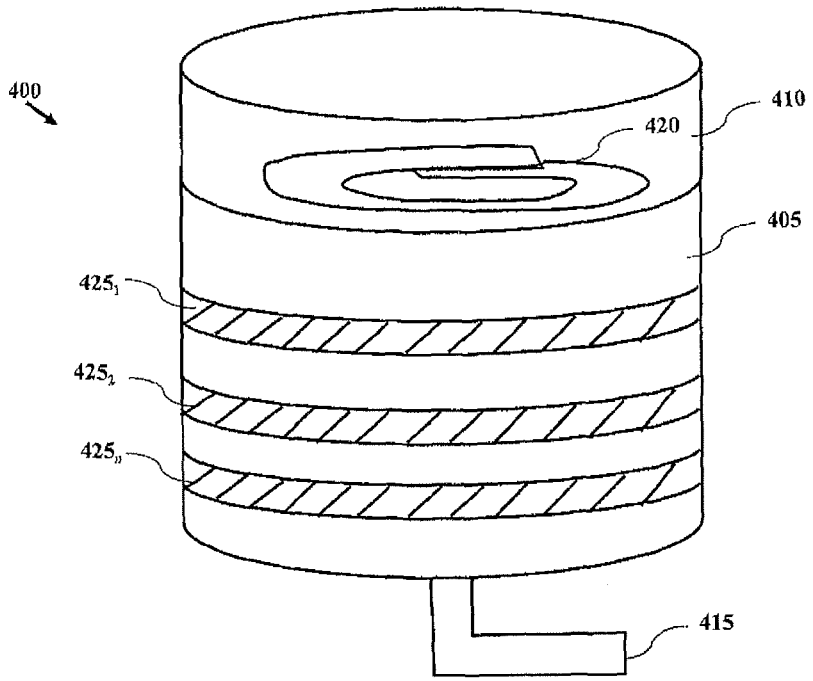
FIG. 4 depicts a graphical representation of a vessel according to one or more embodiments.

FIG. 4 depicts a graphical representation of a vessel according to one or more embodiments. According to one embodiment, vessel 400 may include one or more elements to rapidly change the temperature (e.g., by heating and/or cooling) within the vessel during one or more cycles. According to another embodiment, elements of vessel 400 may be employed with the vessel of system 100 of FIG. 1 for removing one or more core elements from a cast component, including ceramic core elements and casting pins.

As shown in FIG. 4, vessel 400 is a cylindrical container including sidewall 405 and vessel lid 410. Although shown as a cylindrical container it should be appreciated that other configurations and shapes maybe employed with vessel 400. Vessel 400 includes discharge 415 to flush solution and/or removed core material during one or more autoclave cycles.

According to one embodiment, vessel 400 includes cooling coil 420. Cooling coil 420 may be positioned in and/or near vessel lid 410 for cooling solution and contents of vessel 400. Cooling coil 420 may be employed for changing the pressure in vessel 400. Cooling coil 420 is shown as an individual coil in FIG. 4, however, it should be appreciated that multiple cooling coils may be used with vessel 400.

According to another embodiment, vessel 400 includes heating bands $\mathbf{4251}_{1\text{-}n}$. Heating bands $\mathbf{4251}_{1\text{-}n}$ may be positioned in and/or near sidewall 405 for heating solution and contents of vessel 400. Heating bands $\mathbf{4251}_{1\text{-}n}$ may be employed for changing the pressure in vessel 400. Heating bands $\mathbf{425}_{1\text{-}n}$ is shown as multiple bands in FIG. 4, however, it should be appreciated that a single heating element may be used with vessel 400 in certain embodiments.

While this disclosure has been particularly shown and described with references to exemplary embodiments thereof, it will be understood by those skilled in the art that various changes in form and details may be made therein without departing from the scope of the claimed embodiments.

What is claimed is:

1. A method for removing core elements of cast components, the method comprising the acts of:

controlling a first high temperature autoclave cycle for a cast component in a vessel with a first solution concentration to remove at least a first portion of core elements, wherein the first solution concentration, temperature and pressure in the vessel are controlled to expose one or more casting pins in the cast component;

controlling a second high temperature autoclave cycle for the cast component in the vessel with second solution concentration, wherein the second solution concentration, temperature and pressure in the vessel during the second high temperature autoclave cycle are controlled to loosen one or more of the casting pins from the cast component; and controlling one or more low temperature autoclave cycles following the second high temperature cycle to remove core and casting pins from the cast component, wherein the one or more low temperature autoclave cycles have a temperature lower than the first high temperature autoclave cycle and the first high temperature autoclave cycle has a temperature lower than the second high temperature autoclave cycle.

2. The method of claim 1, wherein the first high temperature autoclave cycle includes heating the vessel to a temperature within the range of 200 to 400 degrees F.

3. The method of claim 1, wherein the solution of the first high temperature autoclave cycle is solution of less than 40% of KOH or less than 40% of NaOH.

4. The method of claim 1, wherein the second high temperature autoclave cycle includes heating the vessel to a temperature within the range of 400 to 600 degrees F.

5. The method of claim 1, wherein the solution of the second high temperature autoclave cycle is solution of at least 40% of KOH or at least 40% of NaOH.

6. The method of claim 1, wherein each high temperature autoclave cycle includes a cooling cycle that is controlled to cycled on and off multiple times during each autoclave cycle to provide repetitive and rapid pressure changes in the vessel, promote agitation, and promote a flushing action in the solution.

7. The method of claim 1, wherein 3-5 low temperature autoclave cycles are initiated in the vessel.

8. The method of claim 1, wherein the autoclave cycles are controlled to remove core elements including ceramic cores and alumina casting pins.

9. The method of claim 1, wherein the autoclave cycles are initiated in a vessel having a volume within the range of 1-50 gallons.

10. The method of claim 1, wherein the each autoclave cycle includes flushing the cast component with a fluid to remove one or more of core and casting pin material.

* * * * *